US011503970B2

(12) United States Patent
Pi et al.

(10) Patent No.: US 11,503,970 B2
(45) Date of Patent: Nov. 22, 2022

(54) VACUUM CLEANER

(71) Applicant: BISSELL Homecare, Inc., Grand Rapids, MI (US)

(72) Inventors: Jian Yun Pi, Gao'an (CN); Kan Yuk Yiu, New Territories (CN)

(73) Assignee: BISSELL Inc., Grand Rapids, MI (US)

( * ) Notice: Subject to any disclaimer, the term of this patent is extended or adjusted under 35 U.S.C. 154(b) by 248 days.

(21) Appl. No.: 16/788,900

(22) Filed: Feb. 12, 2020

(65) Prior Publication Data

US 2020/0178744 A1 Jun. 11, 2020

Related U.S. Application Data

(63) Continuation of application No. 15/717,311, filed on Sep. 27, 2017, now Pat. No. 10,561,290.

(Continued)

(51) Int. Cl.
*A47L 9/20* (2006.01)
*A47L 9/14* (2006.01)

(Continued)

(52) U.S. Cl.
CPC ..... *A47L 9/20* (2013.01); *A47L 5/225* (2013.01); *A47L 5/24* (2013.01); *A47L 5/28* (2013.01);

(Continued)

(58) Field of Classification Search
CPC ..... A47L 9/20; A47L 9/14; A47L 9/16; A47L 9/244; A47L 9/248; A47L 5/00;

(Continued)

(56) References Cited

U.S. PATENT DOCUMENTS 2,077,572 A 4/1937 Lofgren
4,426,211 A * 1/1984 Ataka ..... A47L 9/1409 15/327.7

(Continued)

FOREIGN PATENT DOCUMENTS

KR 100547416 * 1/2006
KR 100547416 B1 1/2006
KR 1020060025429 A 3/2006

OTHER PUBLICATIONS

Intellectual Property Office, Combined Search and Examination Report under Sections 17 & 18 (3) re Corresponding Application No. GB2020168.7, dated Mar. 1, 2021, 5 pages, South Wales, NP.

(Continued)

*Primary Examiner* — Robert J Scruggs
(74) *Attorney, Agent, or Firm* — McGarry Bair PC

(57) ABSTRACT

A vacuum cleaner includes an improved dual-action filter cleaning mechanism using both a rotational flicking action and a vertical shaking action. A debris removal assembly of the vacuum cleaner can include a filter assembly having a first filter and a second filter arranged in a nested configuration, and a filter cleaning mechanism configured to impart a combination of vertical shaking of the first filter and rotational flicking of the second filter. The filter cleaning mechanism can include a camming mechanism configured to simultaneously move the first filter along the axis and rotate the first filter about the axis while the second filter remains stationary.

20 Claims, 15 Drawing Sheets

Related U.S. Application Data

(60) Provisional application No. 62/401,300, filed on Sep. 29, 2016.

(51) Int. Cl.

| | |
|---|---|
| ***A47L 9/28*** | (2006.01) |
| ***A47L 5/28*** | (2006.01) |
| ***A47L 5/22*** | (2006.01) |
| ***A47L 5/24*** | (2006.01) |
| ***A47L 5/30*** | (2006.01) |
| ***A47L 9/12*** | (2006.01) |

(52) U.S. Cl.
CPC ..... *A47L 5/30* (2013.01); *A47L 9/125* (2013.01); *A47L 9/149* (2013.01); *A47L 9/2857* (2013.01); *A47L 9/2884* (2013.01)

(58) Field of Classification Search
CPC ... A47L 5/225; A47L 5/24; A47L 5/28; A47L 5/30; A47L 9/125; A47L 9/149; A47L 9/2857; A47L 9/2884; A47L 9/1666; A47L 9/1691; A47L 9/1683
See application file for complete search history.

(56) References Cited

U.S. PATENT DOCUMENTS

| | | | | |
|---|---|---|---|---|
| 5,699,585 | A * | 12/1997 | Tomooka | A47L 9/0027 15/327.2 |
| 5,704,956 | A | 1/1998 | Loveless et al. | |
| 6,546,592 | B1 | 4/2003 | Pears | |
| 6,994,739 | B2 * | 2/2006 | Park | A47L 9/1666 55/337 |
| RE40,542 | E | 10/2008 | Bone | |
| 7,572,307 | B2 | 8/2009 | Coburn | |
| 7,779,507 | B2 * | 8/2010 | Jung | A47L 5/30 15/348 |
| RE43,603 | E | 8/2012 | Bone | |
| 8,308,831 | B2 | 11/2012 | Coburn | |
| 8,424,154 | B2 | 4/2013 | Beskow et al. | |
| 8,549,704 | B2 | 10/2013 | Milligan | |
| 9,009,912 | B2 * | 4/2015 | Conrad | A47L 9/1608 15/347 |
| 9,521,936 | B2 | 12/2016 | Holz | |
| 2003/0019074 | A1 * | 1/2003 | Oh | A47L 9/1691 15/352 |
| 2005/0022335 | A1 * | 2/2005 | Gerth | A47L 9/00 15/352 |
| 2007/0056135 | A1 | 3/2007 | Sasaki et al. | |
| 2007/0209150 | A1 | 9/2007 | Gogel et al. | |
| 2007/0271724 | A1 * | 11/2007 | Hakan | A47L 9/1666 15/329 |
| 2010/0287716 | A1 * | 11/2010 | Kasper | A47L 11/26 15/4 |
| 2013/0091815 | A1 | 4/2013 | Smith | |
| 2014/0082883 | A1 | 3/2014 | Tran | |
| 2014/0208538 | A1 * | 7/2014 | Visel | A47L 5/24 15/344 |
| 2015/0265120 | A1 | 9/2015 | Han et al. | |

OTHER PUBLICATIONS

KR1020060025429, Machine Translation.
KR100547416B1, Bibliographic Data.

* cited by examiner

VACUUM CLEANER

CROSS-REFERENCE TO RELATED APPLICATION(S)

This application is a continuation of U.S. patent application Ser. No. 15/717,311, filed Sep. 27, 2017, now U.S. Pat. No. 10,561,290, which claims the benefit of U.S. Provisional Patent Application No. 62/401,300, filed Sep. 29, 2016, all of which are incorporated herein by reference in their entirety.

BACKGROUND

Vacuum cleaners can be embodied as upright units or portable, hand-carriable units. In some instances, a vacuum cleaner can be reconfigurable between an upright cleaning mode and a handheld mode. Many recent handheld vacuum cleaners use at least one cyclonic cleaning stage. Other handheld vacuum cleaners include non-cyclonic cleaning stages, such as filters or filter bags.

BRIEF DESCRIPTION

An aspect of the present disclosure relates to vacuum cleaner including a working air path comprising a dirty air inlet and a clean air outlet, a motor/fan assembly in fluid communication with the dirty air inlet and a debris removal assembly including a dirt cup, a filter assembly, and a filter interlock mechanism that physically prevents installation of the dirt cup if the filter assembly is not installed.

DETAILED DESCRIPTION

Aspects of the present disclosure relate to vacuum cleaners. In one of its aspects, the disclosure relates to an upright or stick vacuum cleaner with a detachable handheld unit. In another aspect, the disclosure relates to filter assemblies for vacuum cleaners.

Figure 1:
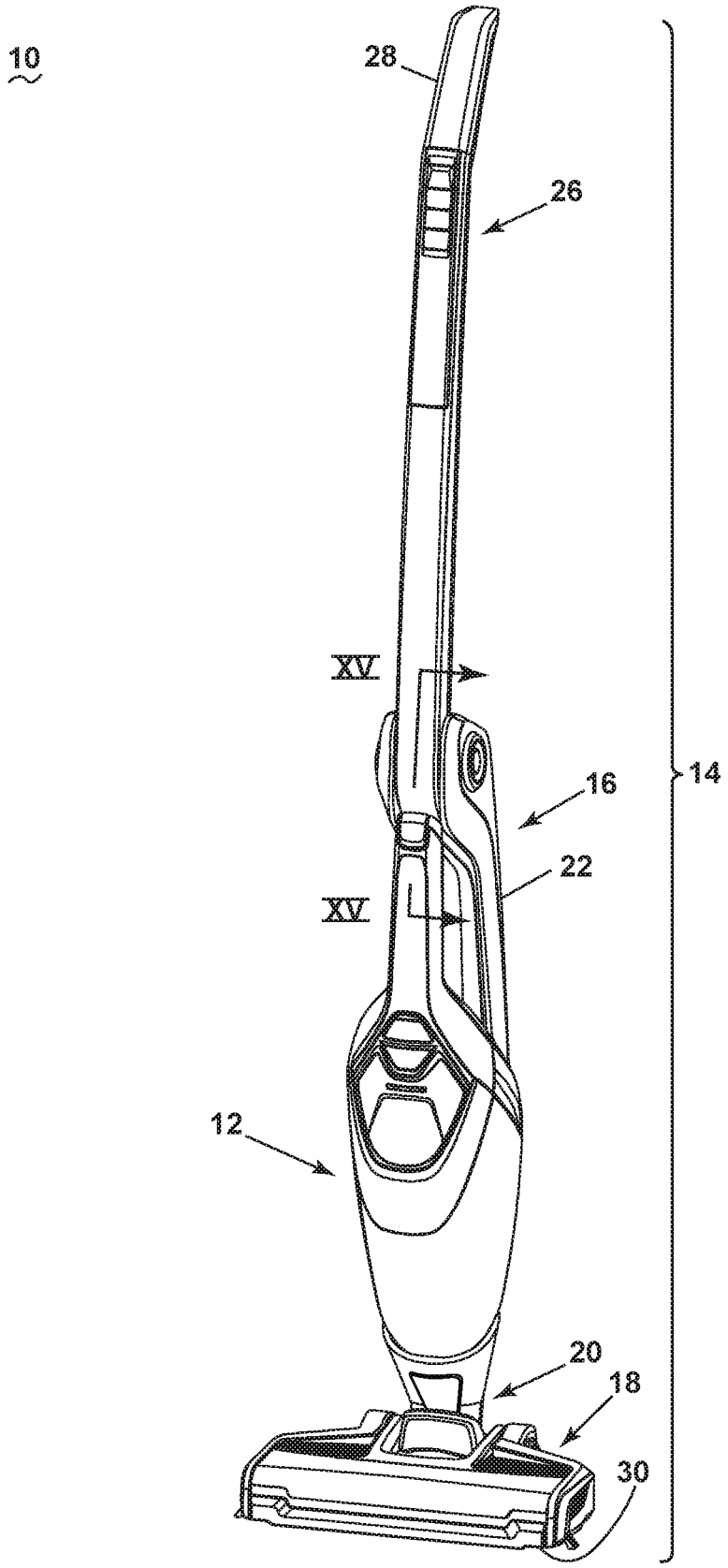
FIG. 1 is a perspective view of a vacuum cleaner with the vacuum cleaner in an upright mode of operation according to aspects of the present disclosure.

FIG. 1 is a perspective view of a vacuum cleaner 10 according to one example of the disclosure, with the vacuum cleaner 10 in an upright mode of operation. As illustrated herein, the vacuum cleaner 10 is an upright or stick vacuum cleaner having a detachable handheld cleaning unit or hand vac 12. The vacuum cleaner 10 includes a housing 14 that includes an upright or stick body 16 that is pivotally connected to a floor cleaning head or base 18 for directing the base 18 across the surface to be cleaned. The stick body 16 can be pivotally connected to the base 18 by a pivot coupling 20. The pivot coupling 20 can be a single axis or multi-axis coupling.

The hand vac 12 is detachable from the housing 14 of the vacuum cleaner 10. As illustrated, the upright stick body 16 includes a main support section or frame 22 having a hand vac receiver 24 on a front side thereof and an elongated handle 26 extending upwardly from the frame 22 that is provided with a hand grip 28 at one end that can be used for maneuvering the vacuum cleaner 10 over a surface to be cleaned. In other examples, the hand vac receiver 24 can be provided on a rear side or lateral side of the frame 22, or on the base 18. In yet another example, the hand vac 12 can be detachable from the handle 26, and may form a portion of or include the handle grip 28 that can be used for maneuvering the vacuum cleaner 10 over a surface to be cleaned when the vacuum cleaner 10 is in the upright mode of operation. In such a case, the handle 26 may define a portion of the working air path through the vacuum cleaner 10.

A suction nozzle 30 can be provided on the floor cleaning head or base 18 adapted to move over the surface to be cleaned. An agitator (not shown) can be provided adjacent to the suction nozzle 30 for agitating the surface to be cleaned so that the debris is more easily ingested into the suction nozzle. Some examples of agitators include, but are not limited to, a horizontally-rotating brushroll, dual horizontally-rotating brushrolls, one or more vertically-rotating brushrolls, or a stationary brush.

A working air conduit 32 can extend though the base 18 and pivot coupling 20, from the suction nozzle 30 to the hand vac receiver 24, in order to place the hand vac 12 in fluid communication with the suction nozzle 30 when the hand vac 12 is secured on the upright stick body 16. The working air conduit 32 can include one or more rigid or flexible conduit sections, or a combination thereof.

The working air conduit 32 defines a portion of the working air path through the vacuum cleaner 10 in the upright mode of operation; the suction nozzle 30 and hand vac 12 also define a portion of the working air path. In the upright mode of operation the working air path can extend through the housing 14, and from a dirty air inlet defined by the suction nozzle 30 to a clean air outlet on the hand vac 12, as described in more detail below.

Figure 2:
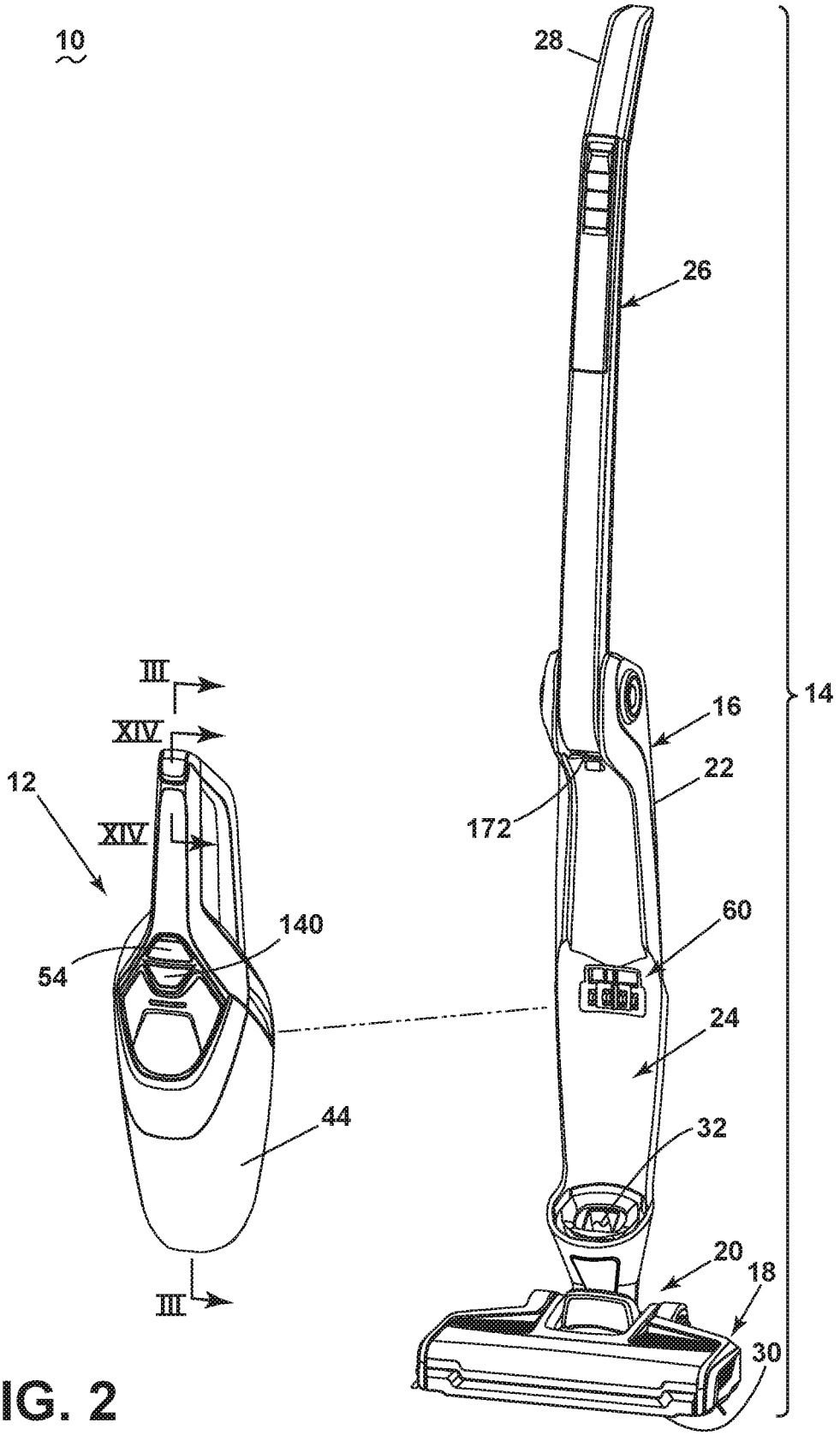
FIG. 2 is a partially exploded view of the vacuum cleaner from FIG. 1, where a hand vac is detached for use in a handheld mode of operation.

FIG. 1 shows the vacuum cleaner 10 in an upright mode of operation in which the hand vac 12 is secured to the housing 14, and more specifically to the upright stick body 16 of the illustrated example. FIG. 2 is a partially exploded view of the vacuum cleaner 10 from FIG. 1, where the hand vac 12 is detached for use in a handheld mode of operation. In the handheld mode of operation, the hand vac 12 is fully operational as a portable, hand-carriable vacuum cleaner.

Figure 3:
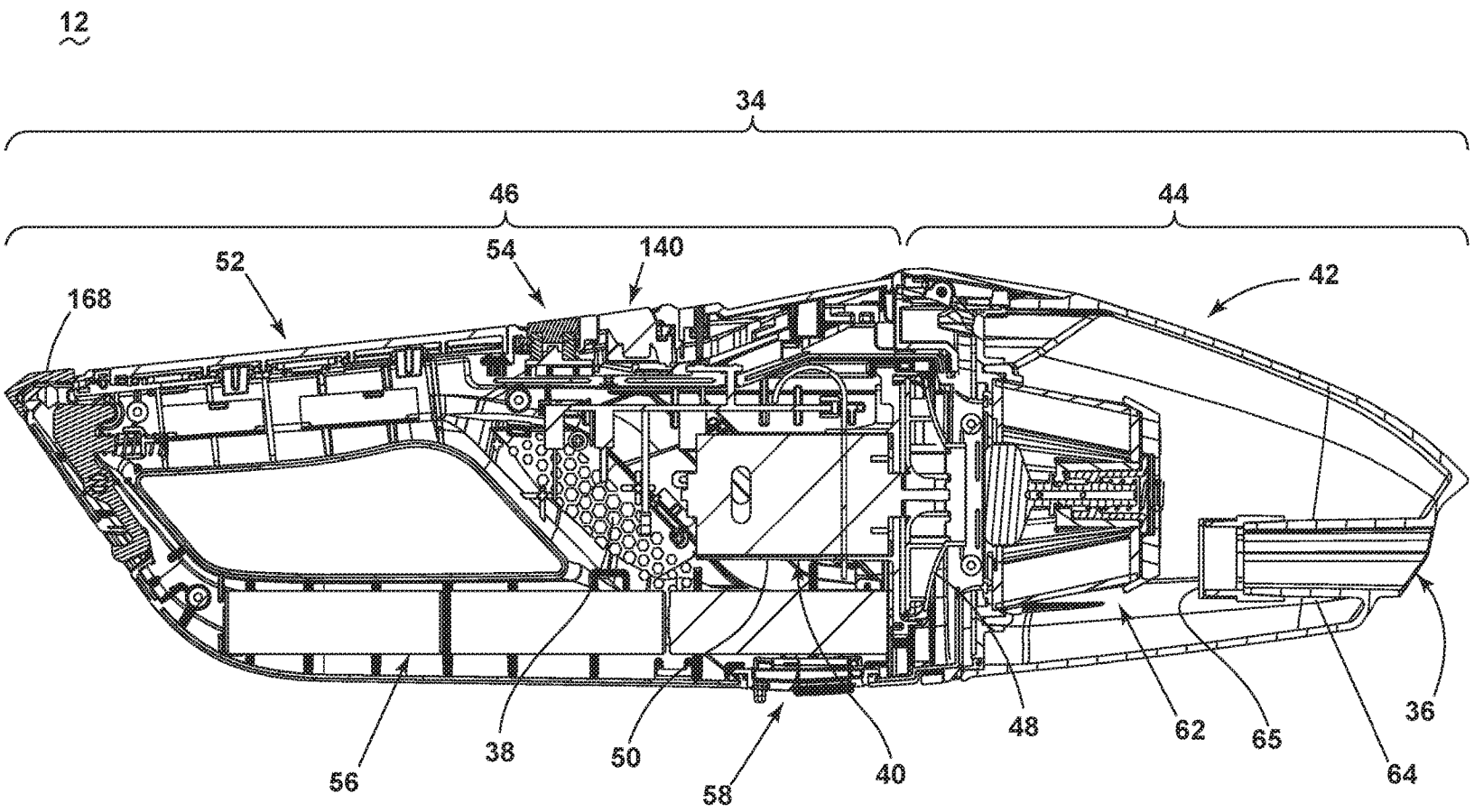
FIG. 3 is a cross-sectional view of the hand vac taken through line of FIG. 2.
Figure 4:
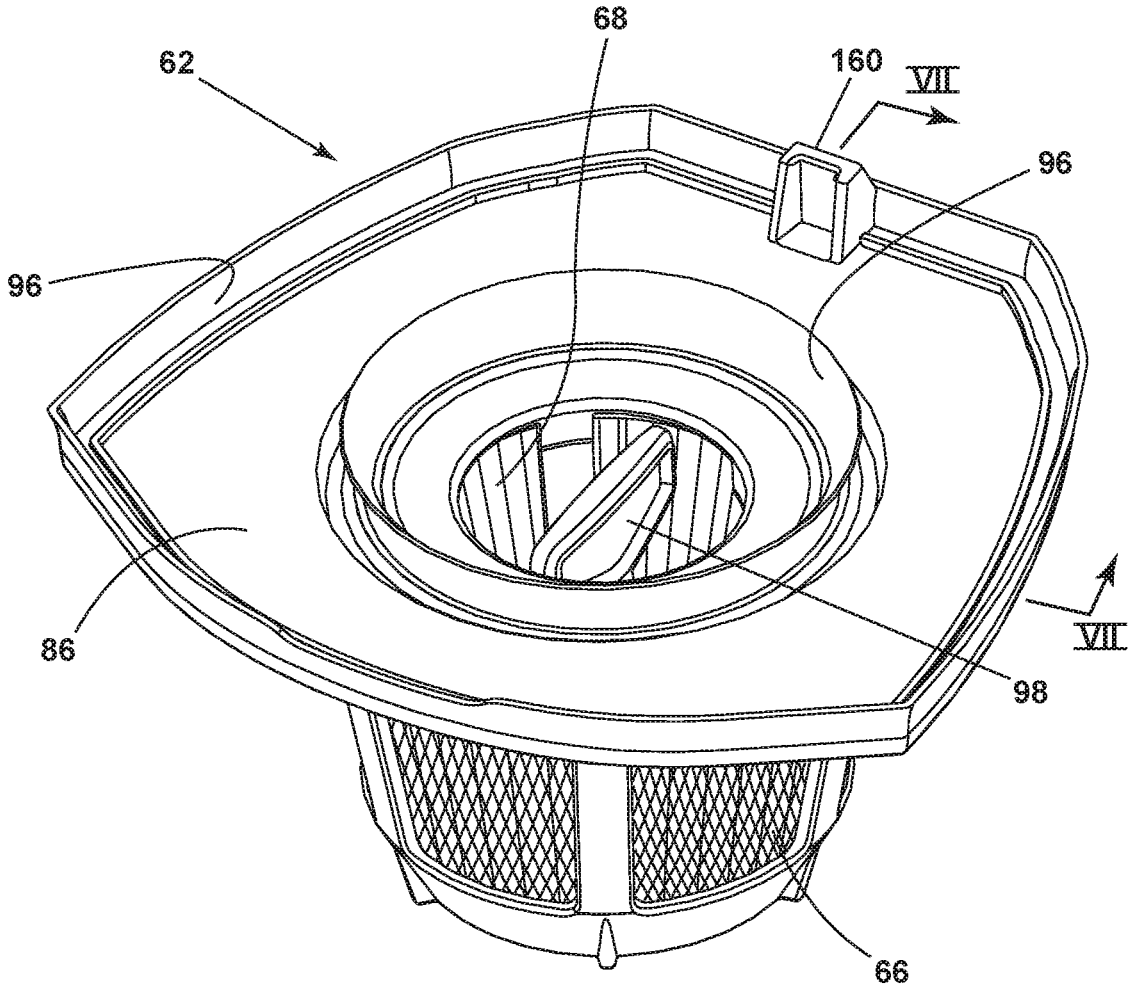
FIG. 4 is a perspective view of a filter assembly having a filter cleaning mechanism.
Figure 5:
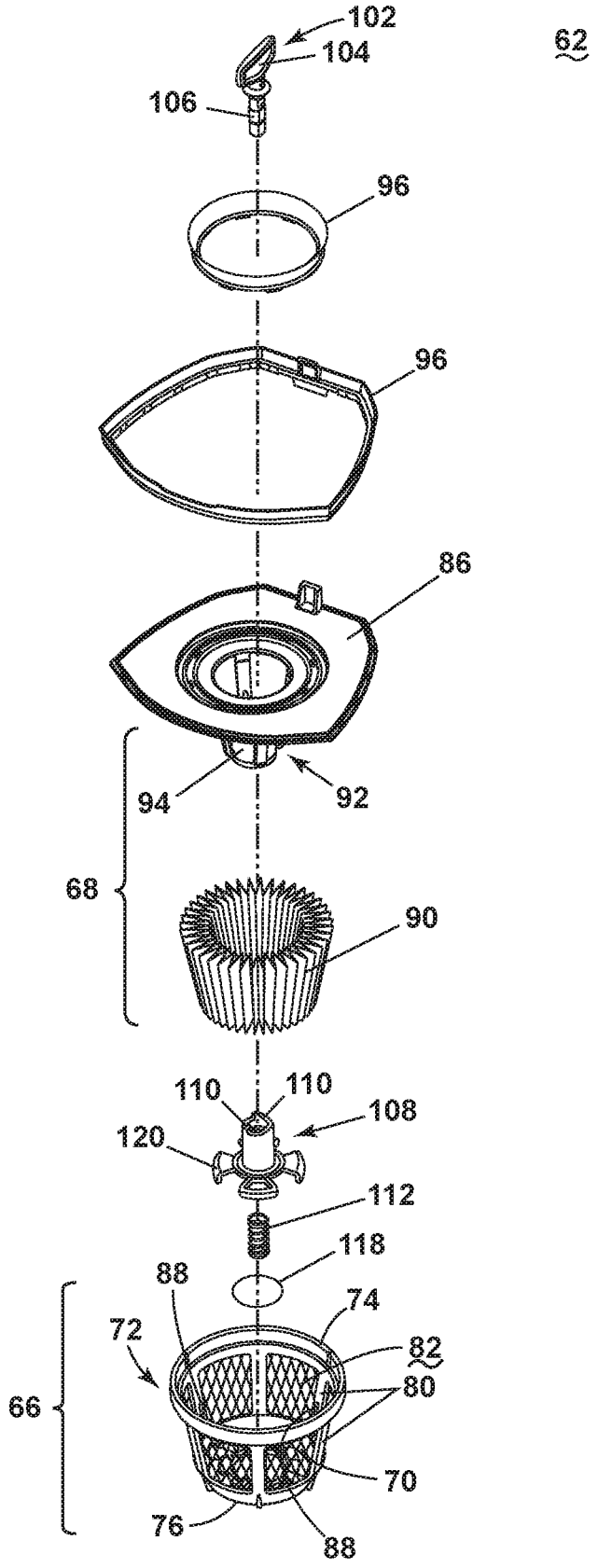
FIG. 5 is an exploded view of the filter assembly and filter cleaning mechanism from FIG. 4.

FIG. 3 is a cross-sectional view through the hand vac 12. The hand vac includes a hand-carriable body 34 housing the components of a vacuum collection system for creating a partial vacuum to suck up debris (which may include dirt, dust, soil, hair, and other debris) from a surface to be cleaned and collecting the removed debris in a space provided on the hand vac for later disposal. Additionally, in some examples of the disclosure the vacuum cleaner 10 can have fluid delivery capability, including applying liquid or steam to the surface to be cleaned, and/or fluid extraction capability.

The vacuum collection system can include a hand vac working air path through the body 34, and may include a dirty air inlet 36 and a clean air outlet 38. The air inlet 36 may be in fluid communication with the suction nozzle 30 in the base 18, such as in the upright mode of operation shown in FIG. 1. In the handheld mode of operation, the air inlet 36 may be used to directly clean a surface. In both modes of operation, the clean air outlet 38 is the air outlet for the working air path.

In addition to the air inlet 36, the vacuum collection system may include one or more of a motor/fan assembly 40 in fluid communication with the air inlet 36 for generating a working airstream, and a debris removal assembly 42 for removing and collecting debris from the working airstream for later disposal, portions of which can define the working air path through the body 34.

The hand vac 12 can include a first housing or dirt cup 44 for the debris removal assembly 42 and a second or motor housing 46 for the motor/fan assembly 40. The motor/fan assembly 40 includes a fan/impeller section 48 and a motor section 50 which are housed in the motor housing 46. The housings 44, 46 are in fluid communication with each other when coupled, and can be secured together to form a single, hand-carriable unit, i.e. the hand carriable body 34.

The second housing 46 can further include a handle grip 52 for the hand vac 12, a power button 54, and a rechargeable battery 56 for convenient handheld operation of the hand vac 12. The power button 54 can electrically couple the motor/fan assembly 40 to the battery 56 and may be positioned or adjacent to a portion of the handle grip 52 so that a user can conveniently operate the power button 54 with the same hand gripping the hand vac 12. The second housing 46 can further include the clean air outlet 38, which is shown in the illustrated example as including a grillwork of openings in a sidewall of the housing 46, although other configurations are possible.

A contact plate 58 can be provided on the body 34 for coupling with a corresponding charging plate 60 (FIG. 2) on the hand vac receiver 24 and charging the battery 56 when the hand vac 12 is attached to the housing 14 of the vacuum cleaner 10. Alternatively, the power source for the hand vac 12 may be a power cord connected to the body 34 and plugged into a household electrical outlet.

In addition to the dirt cup 44 for receiving and collecting separated contaminants, the debris removal assembly 42 can include a filter assembly 62 for separating contaminants from a working airstream. The filter assembly 62 can be a pre-motor filter assembly provided downstream of the dirty air inlet 36 and upstream of the motor/fan assembly 40, with the working air path extending through the pre-motor filter assembly 62. Alternatively, the debris removal assembly 42 can include a cyclonic or centrifugal separator, a flexible and air-permeable filter bag, or other air filtering means.

The filter assembly 62 can be located within the dirt cup 44. The dirt cup 44 can be removable from the second housing 46 for emptying the contaminants collected in the dirt cup 44 and for cleaning the filter assembly 62. When the dirt cup 44 is removed from the second housing 46, the filter assembly 62 can be removed from the dirt cup 44.

The dirty air inlet 36 of the illustrated example includes an inlet duct 64 formed with the dirt cup 44. The inlet duct 64 extends away from a forward end or nose of the dirt cup 44, in the orientation shown in FIG. 3 in which the hand vac 12 is resting on a horizontal surface, and can include a flap 65 at an outlet end of the duct 64 which is normally closed to prevent dirt from falling out of the dirt cup 44 and which opens automatically when the motor/fan assembly 40 generates a working airstream though the hand vac 12. As shown, the inlet duct 64 is integral with the dirt cup 44. Other configurations for the dirty air inlet 36 are possible.

The hand vac 12 can be used to effectively clean a surface by removing debris (which may include dirt, dust, soil, hair, and other debris) from the surface in accordance with the following method. Referring to FIG. 3 in particular, to perform vacuum cleaning in the handheld mode, the motor/fan assembly 40 draws in debris-laden air through the air inlet 36 and into the debris removal assembly 42 where at least some or all debris in the working air is filtered out from the working airstream. Air passes through the filter assembly 62, which can retain at least some debris or knock debris into the dirt cup 44. The air then passes generally rearwardly through the motor/fan assembly 40 and may exit the housing 46 via the clean air outlet 38. In some examples, a post-motor filter (not shown) may be provided between an outlet from the motor/fan assembly 40 and the clean air outlet 38. The debris removal assembly 42 can be periodically emptied of debris by separating the dirt cup 44 from the second housing 46. Likewise, the filter assembly 62, as well as any additional filters, can periodically be cleaned or replaced while the dirt cup 44 is removed.

Operation in the upright mode (FIG. 1) can be substantially similar. With the hand vac 12 secured on the upright stick body 16, the motor/fan assembly 40 initially draws in debris-laden air through the suction nozzle 30 and working air conduit 32 before entering the air inlet 36 of the hand vac 12. The remaining operation is the same. The debris removal assembly 42 can be periodically emptied of debris by removing the dirt cup 44 from the upright stick body 16. The hand vac 12 may optionally be removed from the upright stick body 16 prior to removing the dirt cup 44. Likewise, the filter assembly 62, as well as any additional filters, can periodically be cleaned or replaced while the dirt cup 44 is removed.

Referring to FIGS. 4-8, an improved filter cleaning mechanism for cleaning a multi-component filter assembly includes a combination of rotational flicking of an internal filter and vertical shaking of an external filter. In one example, the internal filter can include a pleated filter media and the external filter can include a mesh screen, although it is understood that the filter cleaning mechanism may be applied to other combinations of internal and external filters.

In the drawings, the filter cleaning mechanism is applied to the pre-motor filter assembly 62 shown in FIG. 3, although it is understood that the filter cleaning mechanism may be applied to other multi-component filter assemblies. The filter assembly 62 is shown as having a first filter 66 and a second filter 68.

The first mesh filter 66 and the second pleated filter 68 can be arranged in a nested configuration. In the illustrated example, the first and second filters 66, 68 are mounted within the dirt cup 44 by a dirt cup cover 86.

The first filter 66 can be a mesh screen 70 supported by a filter frame 72. The filter frame 72 includes a generally truncated conical shape including an open rim 74 at the top and a closed bottom wall 76 having a plurality of slots 78. A plurality of vertical supports 80 span between the rim 74 and bottom wall 76 to define a plurality of air flow openings 82, and the mesh screen 70, which may include a fine, air permeable mesh screen material, is fastened to the inside of the filter frame 72 around the entire perimeter to cover the air flow openings 82. In one example, filter frame 72 can include a thermoplastic injection molded component and the mesh screen 70 can be insert molded together with the filter frame 72 to form the first filter 66. The vertical supports 80 further include vertical ribs 88 that protrude inwardly and are in register with the second filter 68 for flicking debris off the second filter 68, which is nested within the first filter 66.

It is noted that the mesh size of the mesh screen 70 may be exaggerated in the figures for clarity. The mesh size of the mesh screen 70 may be defined by the number of openings per linear inch of mesh material. As the mesh size increases the size of each opening decreases, and as the mesh size decreases the size of each opening increases. The thickness of each wire forming the mesh can also affect the size of each opening and the overall strength and durability of the mesh screen 70. For instance, using relatively thick wire can reduce the size of individual mesh openings and thereby reduce the total open area per linear inch of mesh material, which can restrict working air flow and potentially cause premature clogging of the mesh screen 70. Conversely, using relatively thin wire can increase the size of individual mesh openings and the total open area per linear inch of mesh material, but can result in a comparatively fragile screen that can be easily punctured or torn. In one example, the mesh size may range from 20 to 60 openings per linear inch, and the wire thickness can be selected to provide at least 50 percent open area. In another example, the mesh size is preferably 30 openings per linear inch with at least 50 percent open area.

The second filter 68 includes a pleated filter media 90 mounted to a second filter frame 92. The second filter frame 92 includes a hub 94 that has a plurality of ramps 100 on an upper inner surface of the hub 94. The second filter frame 92 supports the pleated filter media 90 on the dirt cup cover 86. As shown, the dirt cup cover 86 is integrally formed with the second filter frame 92; in alternative examples, the second filter frame 92 may be separate from the dirt cup cover 86 and configured to attach thereto by a suitable mounting mechanism. The filter frame 92 can extend downwardly from an interior surface of the dirt cup cover 86 that faces the interior of the dirt cup 44 when the dirt cup cover 86 is mounted on the dirt cup 44.

The first mesh filter 66 can be removably mounted over the second pleated filter 68 the nested configuration. To mount the mesh filter 66, the rim 74 of the frame 72 is slidably received within a collar 84 formed on the bottom of a dirt cup cover 86. Seals 96 can be provided between the cover 86 and the dirt cup 44 and between the cover 86 and the second filter 68 to prevent the working air flow from escaping from the working air path.

The filter cleaning mechanism imparts a combination of rotational flicking of the internal or second pleated filter 68 and vertical shaking of the external or first mesh filter 66. The filter cleaning mechanism of the illustrated example includes a filter cleaning key 98 which is adapted for rotation by a user. The filter cleaning mechanism is configured such that rotation of the filter cleaning key 98 results in a combination of rotational flicking of the inner pleated filter 68 and vertical shaking of the outer mesh filter 66.

The filter cleaning key 98 of the illustrated example includes a two-piece user-rotatable filter cleaning key assembly that is rotatably mounted to the hub 94. The two-piece key assembly includes an upper key portion 102 having a user-twistable handle portion 104 that is accessible from an upper side of the dirt cup cover 86 and a shaft 106 extending from the handle portion 104, and a lower key portion 108 that is slidably received on the shaft 106 within and below the hub 94.

The filter cleaning key 98 is rotatably received by the hub 94, with the shaft 106 and a portion of the lower key portion 108 received within an interior of the hub 94. An upper end of the lower key portion 108 includes ramps 110 that mate with the ramps 100 on the interior of the hub 94. The ramps 110 on the lower key portion 108 are configured to slide and rotate with respect to the ramps 100 on the hub 94, which are stationary, as the filter cleaning key 98 is twisted in a clockwise direction by a user. As the key 98 is rotated, the ramps 110 on the lower key portion 108 slide against the ramps 100 on the hub 94 and wedge the lower key portion 108 away from the handle portion 104 axially, i.e. along a key axis X defined by the shaft 106.

A compression spring 112 is mounted within a cavity 114 formed in the bottom of the lower key portion 108, and biases the lower key portion 108 upwardly axially, i.e. along the key axis X defined by the shaft 106. An upper end of the spring 112 is contained by a rim 116 in the cavity 114 and the bottom of the spring 112 is contained by a cover 118 fastened to the bottom of the lower key portion 108. The spring 112 is configured to slide the lower key portion 108 axially upwardly on the shaft 106 towards the handle portion 104.

The lower key portion 108 further includes a flange 120 extending outwardly from the bottom end. The flange 120 includes features of a bayonet mount or connector for removably fastening the lower key portion 108 to the first filter frame 72, which prevents the lower key portion 108 from rotating when the handle portion 104 is rotated to actuate the filter cleaning mechanism, but still allows the filter assembly 62 to be disassembled for replacement of either filter media. The filter cleaning key 98 can rotate in the opposite direction of the bayonet mount so as to avoid inadvertently detaching the lower key portion 108 during filter cleaning.

Figure 6:
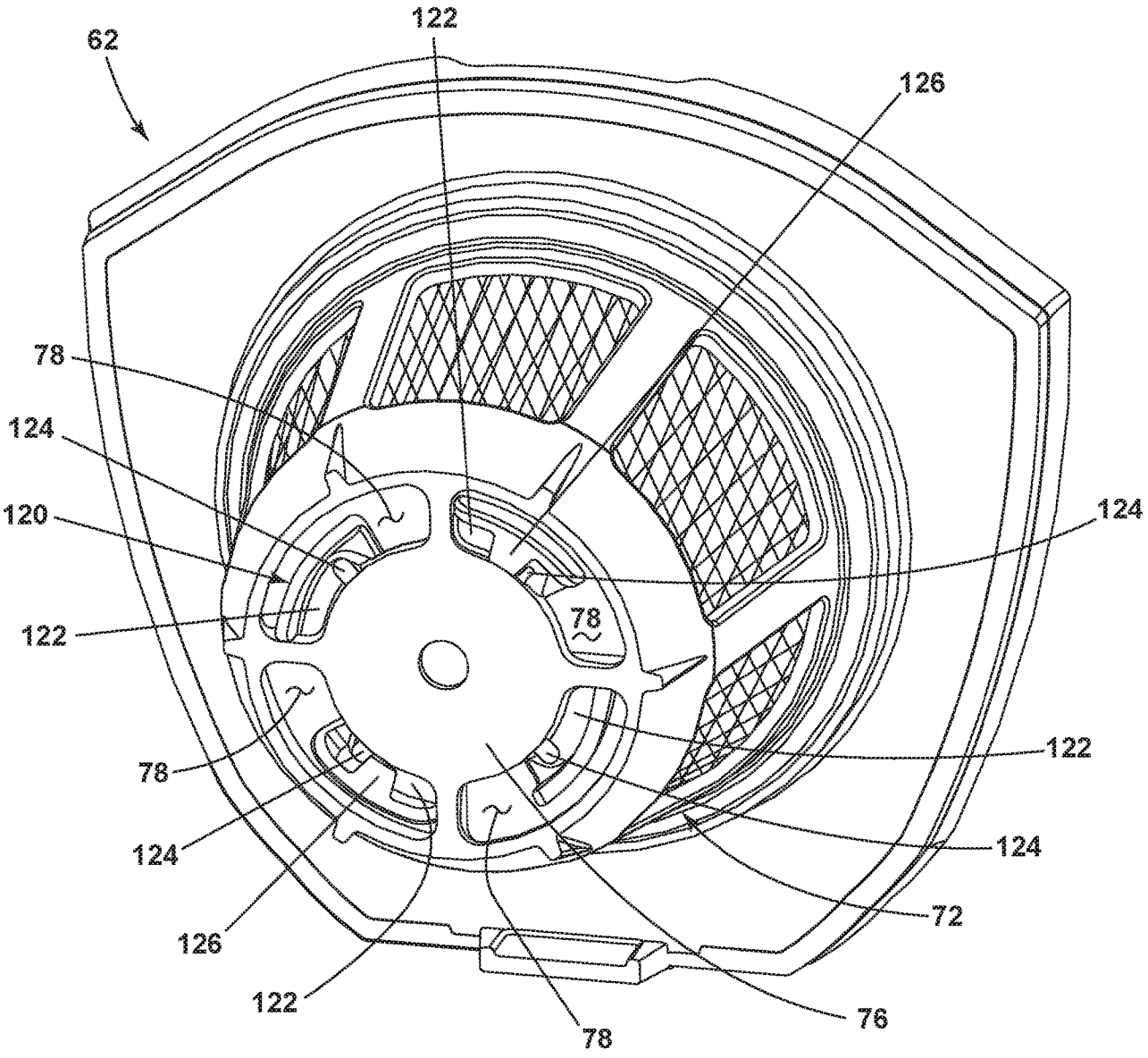
FIG. 6 is a bottom view of the filter assembly and filter cleaning mechanism from FIG. 4.

With reference to FIG. 6, as discussed above, the bottom wall 76 of the first mesh filter frame 72 is provided with multiple slots 78. The filter frame 72 includes shoulders 122 adjacent the slots 78 having a detent 124 at one end. The flange 120 on the lower end of the key 98 is provided with multiple bayonet lugs 126 which can be retained on the shoulders 122 by the detents 124 in order to mount the lower key portion 108 to the frame 72. In the illustrated example, the number of bayonet lugs 126 may be fewer than the number of slots 78 and shoulders 122; for example, four slots 78 and shoulders 122 can be provided on the frame 72 and spaced evenly about the key axis X, while two opposing bayonet lugs 126 can be provided on the lower key portion 108. In other configurations, the same number of slots, shoulders, and lugs can be provided.

To unite the lower key portion 108 of the key 98 and the frame 72, the bayonet lugs 126 are positioned in slots 78, and the parts are rotated relative to each other to move the bayonet lugs 126 over the shoulders 122. The detents 124 retain the lugs 126 on the shoulders 122. With the lower key portion 108 engaged with the first mesh filter frame 72, the filter cleaning key 98 and first mesh filter 66 rotate in unison, with the first mesh filter 66 being rotated around the outer surface of the second pleated filter 68.

Figure 7:
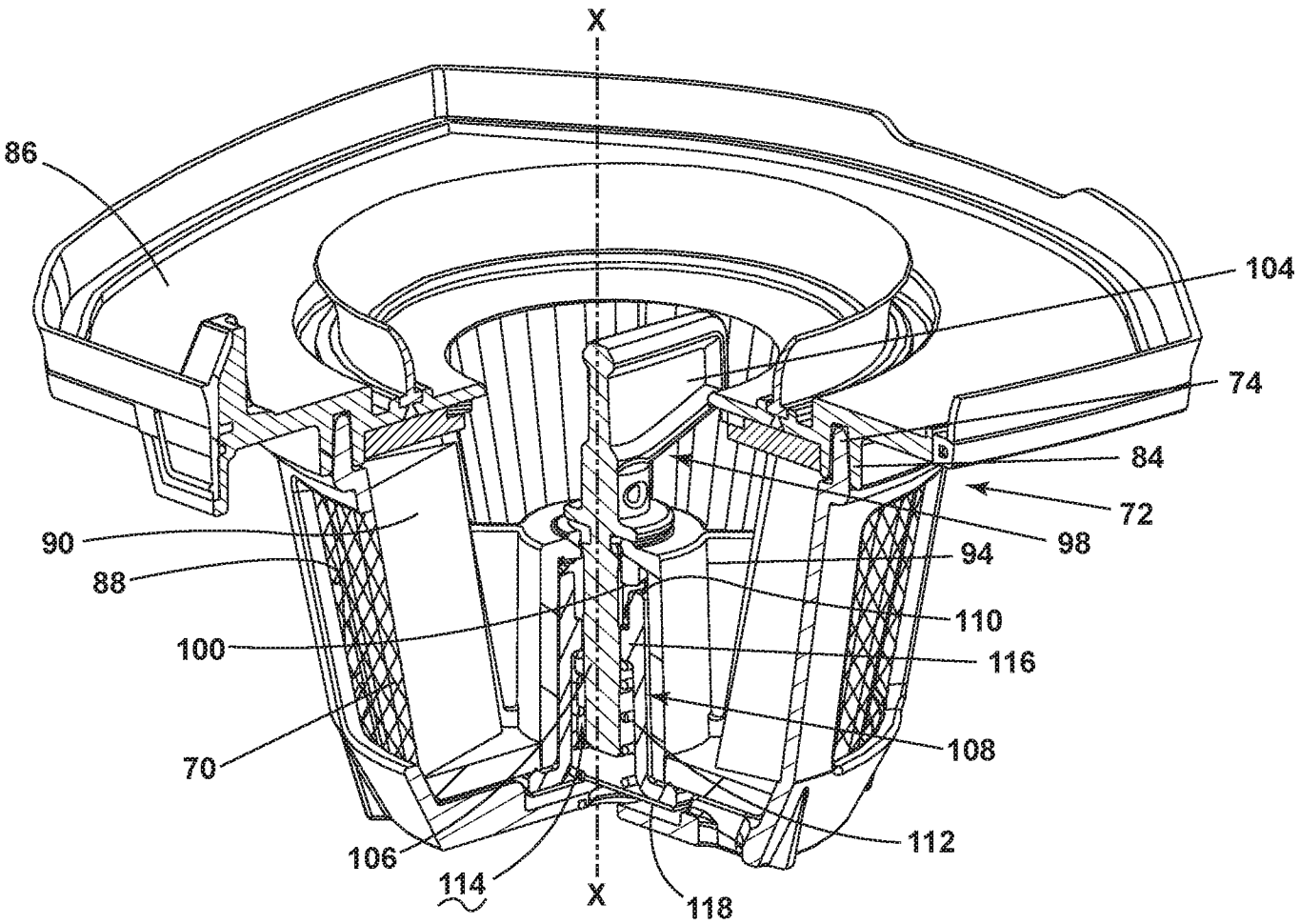
FIG. 7 is a partial section view of the filter assembly showing the engages between the ramps on the hub and key of the filter cleaning mechanism.
Figure 8:
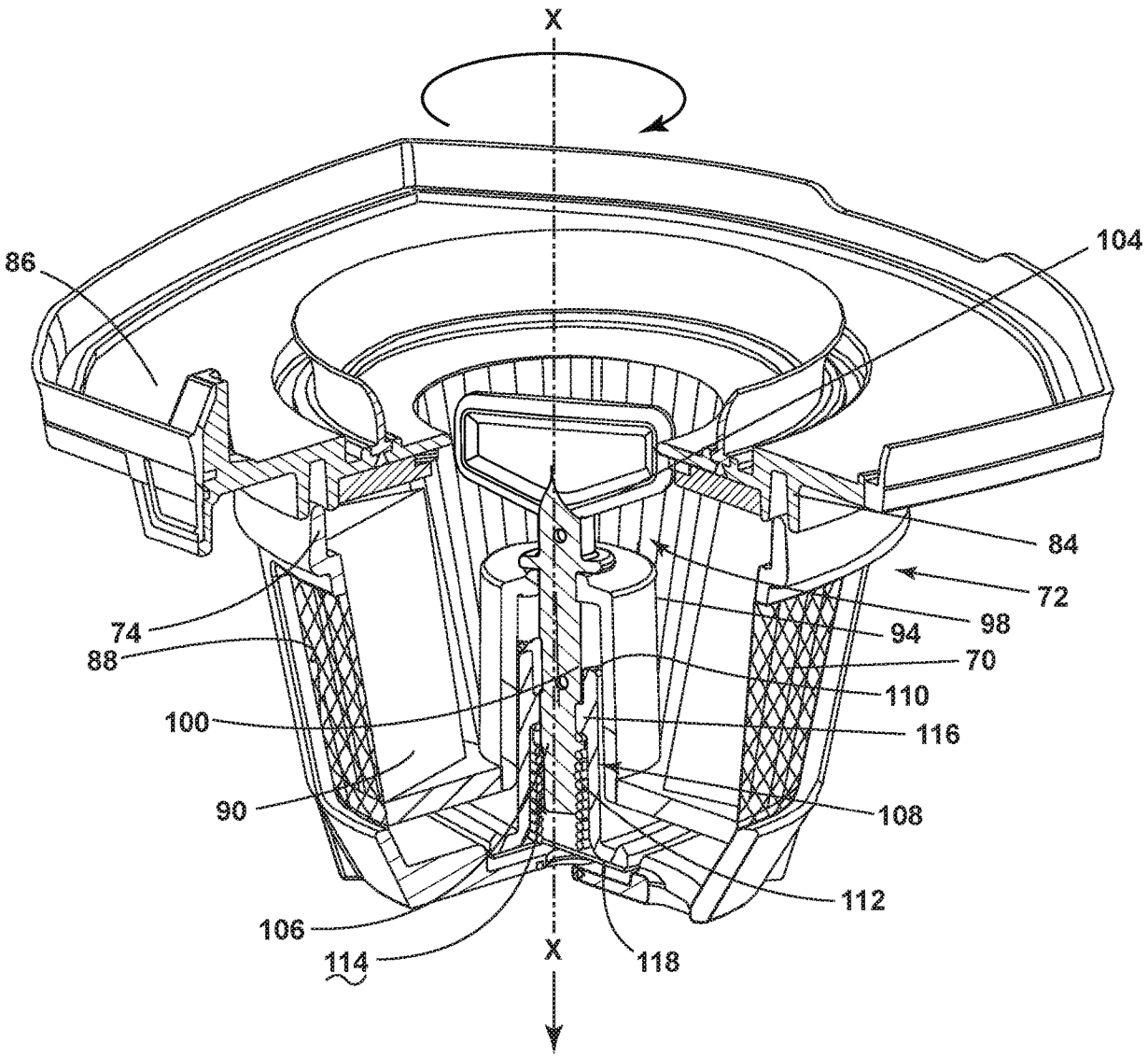
FIG. 8 is a partial section view of the filter assembly showing operation of the filter cleaning mechanism.

With reference to FIGS. 7-8, in operation, a user can rotate the filter cleaning key 98 to shed debris from the mesh filter 66 and pleated filter 68. The filter assembly 62 may start in the position shown in FIG. 7. When the key 98 is rotated, as shown in FIG. 8, the mesh filter 66 rotates together with the key 98, and the vertical ribs 88 flick the pleats of the pleated filter media 90, thus flicking debris off the pleated filter 68. At the same time, the lower key portion 108 is wedged away from the handle portion 104 as the ramps 110 on the lower key portion 108 slide against the ramps 100 on the hub 94. This forces the mesh filter 66 downwardly as shown in FIG. 8. When the peak or end of one of the lower ramps 110 reaches the peak or end of one of the upper ramps 100, the ramps 110 on the lower key portion 108 is forced upwardly into the recess between ramps 100 on the hub 94 by the compression spring 112, causing the lower key portion 108 to snap back towards the handle portion 104, to the vertical position shown in FIG. 7; the position of the key 98 will be different than shown in FIG. 7, for example, rotated by approximately 120 degrees. The mesh filter 66 moves together with the lower key portion 108 and snaps upwardly and shakes debris off the screen 70. The impact also shakes the pleated filter 68 and can shake debris off the pleated filter media 90 as well. The flicking of the pleated filter 68 in combination of the reciprocating vertical movement and snapping action of the mesh filter 66 operates to flick and/or shake debris off both filters 66, 68, which prolongs filter life and reduces clogging.

The filter cleaning mechanism in the example shown herein includes a camming mechanism configured to simultaneously move the first filter 66 along the axis X and rotate the first filter 66 about the axis X while the second filter 68 remains stationary. The ramps 110 on the key 98 are wedge cams having rotating motion. The ramps 110 collectively define a cam surface. The ramps 100 on the inner surface of the hub 94 are followers which translate or oscillate vertically depending on how many degrees the key 98 is rotated. The ramps 110 collectively define a cam follower surface. The followers 100 are constrained by the hub 94 and second filter frame 92, which are fixed within the dirt cup 44 and which form a guide for the followers 100. The coupled first filter frame 72 and lower key portion 108 forms a frame that supports the wedge cams 110. The spring 112 maintains contact between the wedge cams 110 and the followers 100.

The camming mechanism as described herein is configured to rotate between a biased free state, one example of which is shown in FIG. 7, and a cammed state, one example of which is shown in FIG. 8. Moving from the free state to the cammed state includes rotating the wedge cams 110 across the followers 100 and forcing the first filter 66 to move axially along the axis X. Simultaneously, the first filter 66 is rotated about the axis X while the second filter 68 remains stationary to flick debris off the second filter media 90. Further rotation returns the filter assembly 62 to the biased free state. Thus, rotation of the key 98 causes cyclic camming of the first filter 66 away from the second filter 68 and the biasing the first filter 66 back.

It is noted that the filter assembly 62 may advantageously remain coupled with the dirt cup 44 during filter cleaning. As discussed previously, the debris removal assembly 42 can be periodically emptied of debris by separating the dirt cup 44 from the second housing 46. With the dirt cup 44 removed but the filter assembly 62 still assembled with the dirt cup 44, the filter assembly 62 can be cleaned via the filter cleaning key 98 as described above. Any debris that is flicked or shaken off the filters 66, 68 falls into the bottom of the dirt cup 44, after which the dirt cup cover 86 and filter assembly 62 can be removed, the dirt cup 44 emptied.

Referring to FIGS. 9-13, a vacuum cleaner is provided with a filter interlock that prevents installation of a dirt cup if a filter assembly, which may be a pre-motor filter assembly, is not installed. In the illustrated example, the filter interlock is shown on the hand vac 12, but in other examples the filter interlock can be used on upright or canister vacuum cleaners, among other types.

The dirt cup 44 is removably coupled to the second housing 46 of the hand vac body 34, and can be retained on the second housing 46 by a latching mechanism. The filter interlock can interfere with the latching mechanism, preventing the installation of the dirt cup 44 on the second housing 46 when the filter assembly 62 is missing from the dirt cup 44.

In the illustrated example, the latching mechanism includes a dirt cup latch 132 that is provided on the second housing 46 and at least one corresponding slot 134 in the dirt cup 44 for receiving a latching end 136 of the dirt cup latch 132. The dirt cup latch 132 can be a lever pivotally mounted to the second housing 46 at an end 138 opposite the latching end 136. A user-engageable dirt cup release button 140 is operably coupled with the dirt cup latch 132 and is configured to pivot the latching end 136 out of the slot 134 when depressed by a user. As shown in the illustrated example, two separate and spaced-apart slots 134 can be provided in the dirt cup 44, and two corresponding latching ends 136 can be provided on the dirt cup latch 132, although in other examples, one or more slots/latching ends can be provided.

In the illustrated example, the dirt cup latch 132 can be at least partially enclosed by a top cover 128 which overlies a portion of the second housing 46. The top cover 128 can include openings for the dirt cup release button 140, and the adjacent power button 54, as well as for the latching ends 136 of the dirt cup latch 132.

The filter interlock can be configured to interfere with or prevent the engagement between the latching end 136 and the slot 134 when the filter assembly 62 is not installed, so that the dirt cup 44 cannot be installed. As illustrated, in one example, the filter interlock includes a spring-loaded actuator 142 mounted to an inner portion of the dirt cup 44 where the filter assembly 62 contacts a rim 144 of the dirt cup 44. The actuator 142 is biased outwardly by a spring (not shown) so it will interfere with a portion of the second housing 46, and prevent the dirt cup 44 from latching to the second housing 46 if the filter assembly 62 is not installed prior to assembling the dirt cup 44 to the second housing 46.

The actuator 142 can be pivotally mounted to the dirt cup 44, and can include a hinge coupling that includes the hinge pin 148 and a hinge barrel 150 formed by multiple knuckles on the dirt cup 44 and on the actuator 142 which are aligned to receive the hinge pin 148. The hinge pin 148 acts as a constraint for the actuator 142 relative to the dirt cup 44, and defines an axis about which the actuator 142 rotates.

The filter interlock further includes an interference member 154 on the hand vac body 34. The interference member 154 can include a rib on a forward end of the second housing 46, such as on the top cover 128 of the second housing 46. The actuator 142 includes first and second ends 156, 158 extending outwardly relative to the pivot axis in different directions. The first end 156 generally faces the interference member 154, while the second end 158 generally faces the interior of the dirt cup 44, for example, toward the filter assembly 62.

Figure 9:
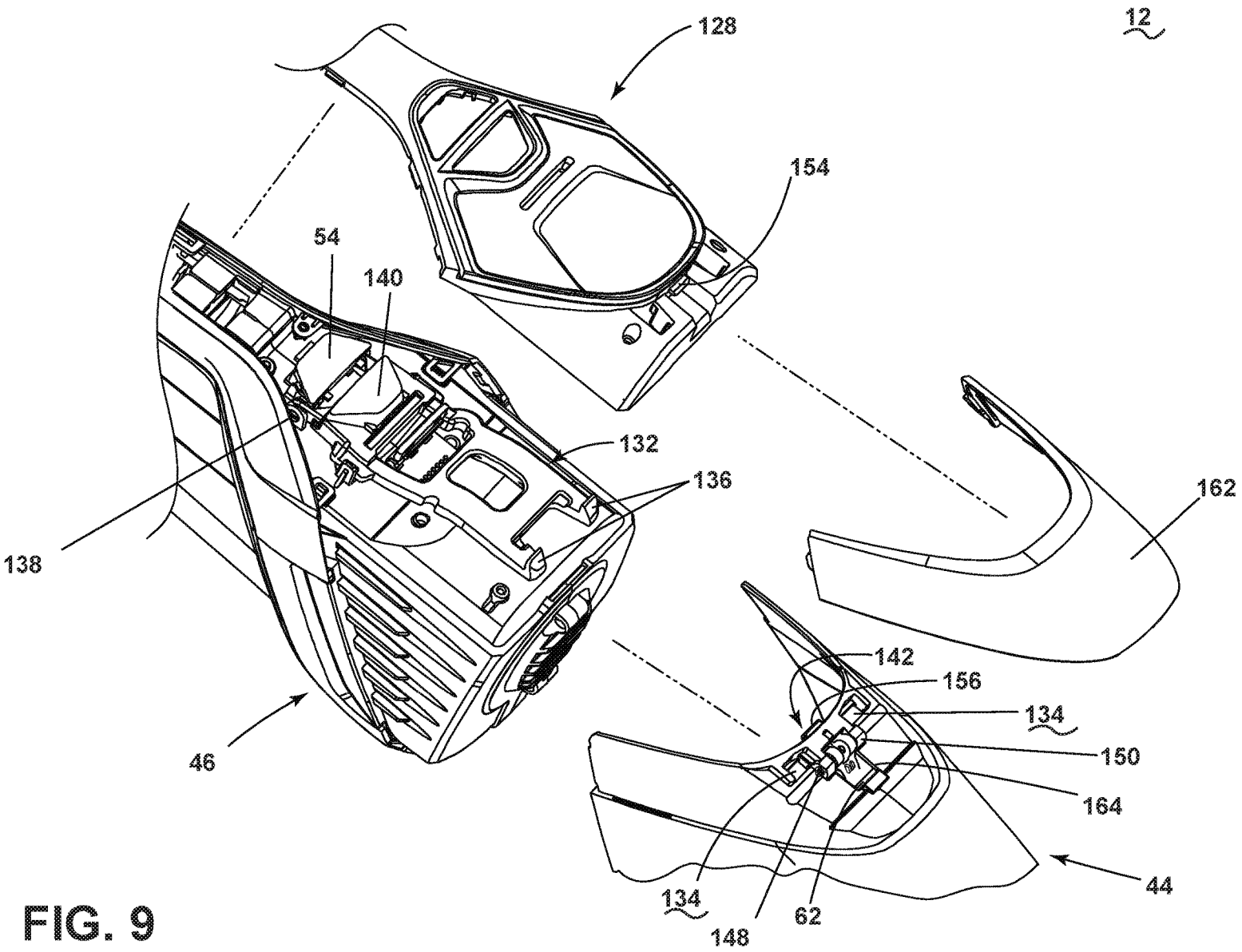
FIG. 9 is a partially exploded view of the hand vac showing a filter interlock for the dirt cup.

As shown in FIG. 9, a cover plate 162 can be fixed to the dirt cup 44 to cover the latching and interlock features of the dirt cup 44. This provides a smooth outer appearance to the dirt cup 44. Also as shown in FIG. 9, a window 164 can be provided in the dirt cup 44 through which the filter assembly 62, if installed, can be viewed from the exterior of the dirt cup 44. This can provide a visual confirmation that the filter assembly 62 is present. In other examples, the cover plate 162 and/or window 164 can be eliminated.

Figure 10:
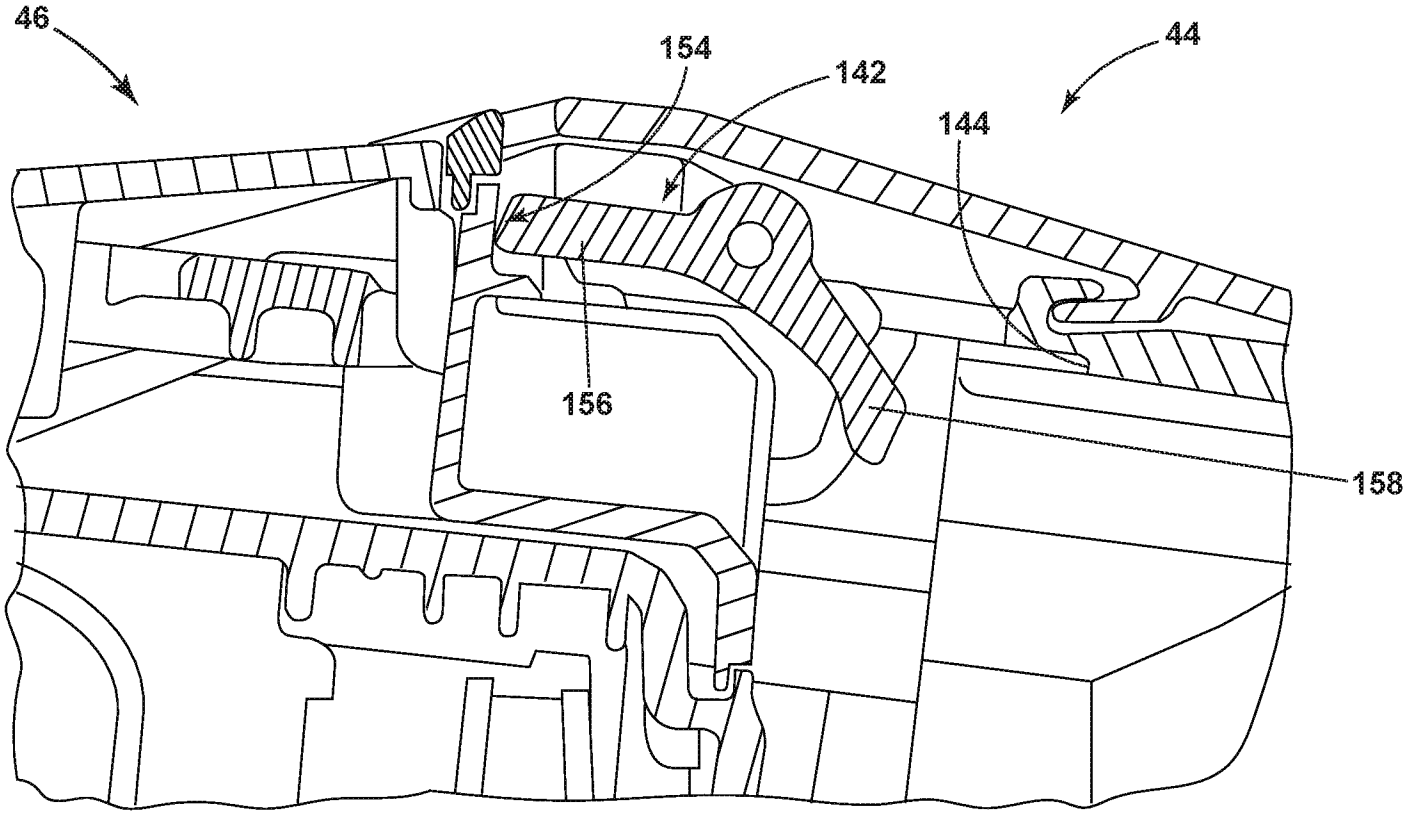
FIGS. 10-11 are views showing the operation of the filter interlock when the filter assembly is missing.
Figure 11:
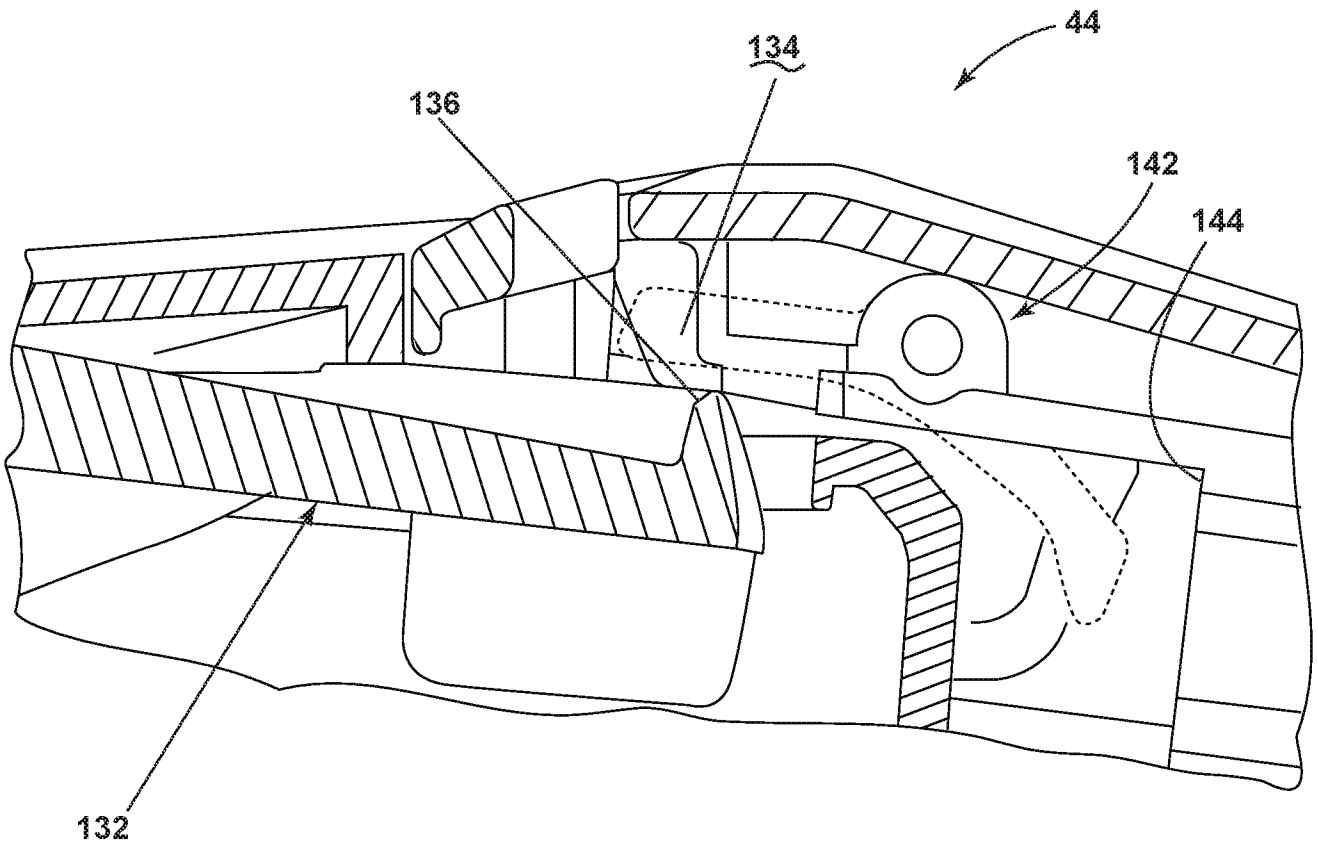

With reference to FIGS. 10-11, the actuator 142 will interfere with the second housing 46 if the filter assembly 62 is missing, so the dirt cup 44 cannot be assembled in placed without the filter assembly 62. In the illustrated example, when the filter assembly 62 is missing, the first end 156 of the actuator 142 will interfere with the interference member 154 on the hand vac body 34, so that the dirt cup latch 132 cannot get into the corresponding slot 134 on the dirt cup 44. Therefore, with the filter assembly 62 missing, the dirt cup 44 cannot be locked in place on the second housing 46.

Figure 12:
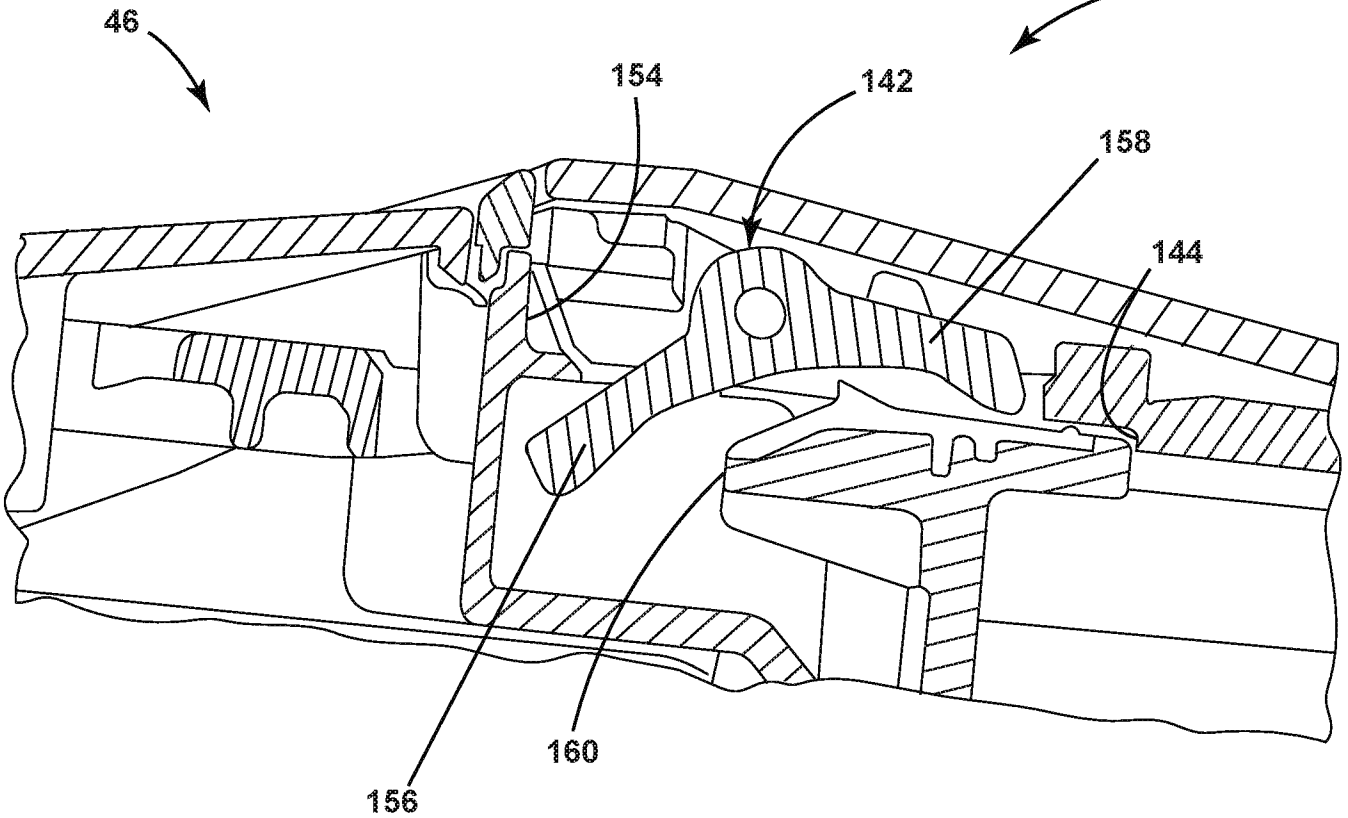
FIGS. 12-13 are views showing the operation of the filter interlock when the filter assembly is in position.
Figure 13:
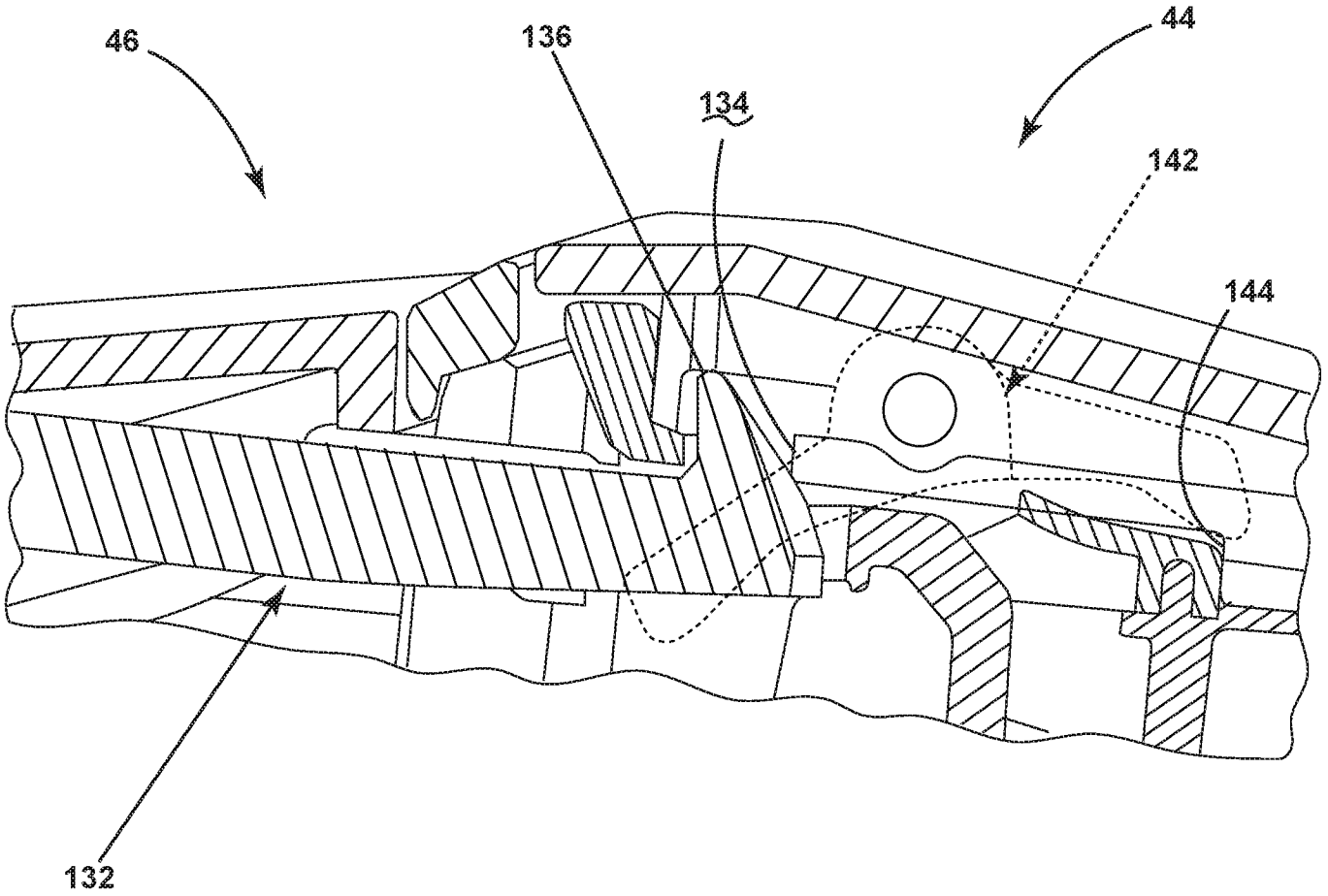

With reference to FIGS. 12-13, the actuator 142 will rotate during assembly of the filter assembly 62 and then stay at this position, without interference with the second housing 46, so the dirt cup 44 can assembly in place and be locked. During insertion of the filter assembly 62 into the dirt cup 44, an actuator rib 160 on the filter assembly 62 contacts the second end 158 of the actuator 142 and rotates the actuator 142 to the position shown in FIG. 12. In the illustrated example, when filter assembly 62 is properly located, the actuator 142 will be rotated to a position in which the first end 156 can slide underneath the interference member 154 on the second housing 46, so that the latching ends 136 of the dirt cup latch 132 can enter the slot 134, and lock the dirt cup 44 in place.

Figure 14:
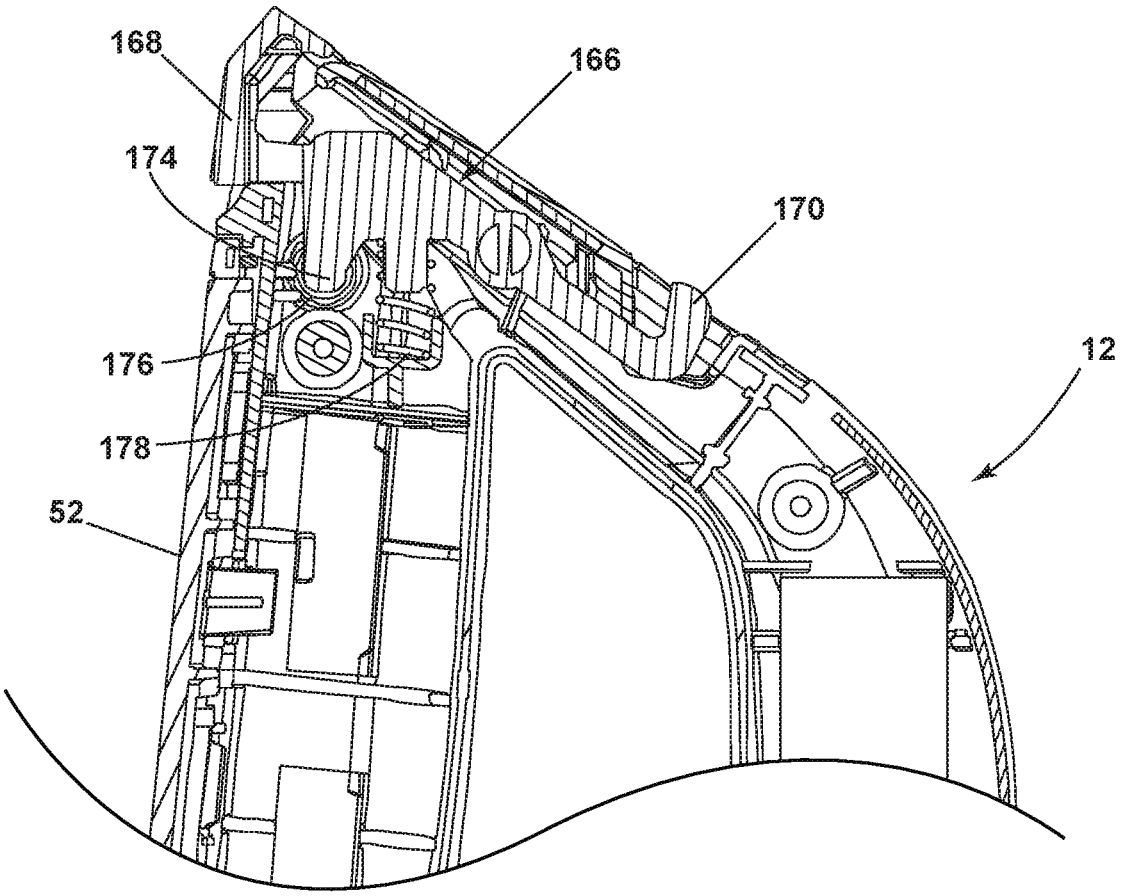
FIG. 14 is a cross-sectional view through a release latch for the hand vac taken through line XIV-XIV of FIG. 2.
Figure 15:
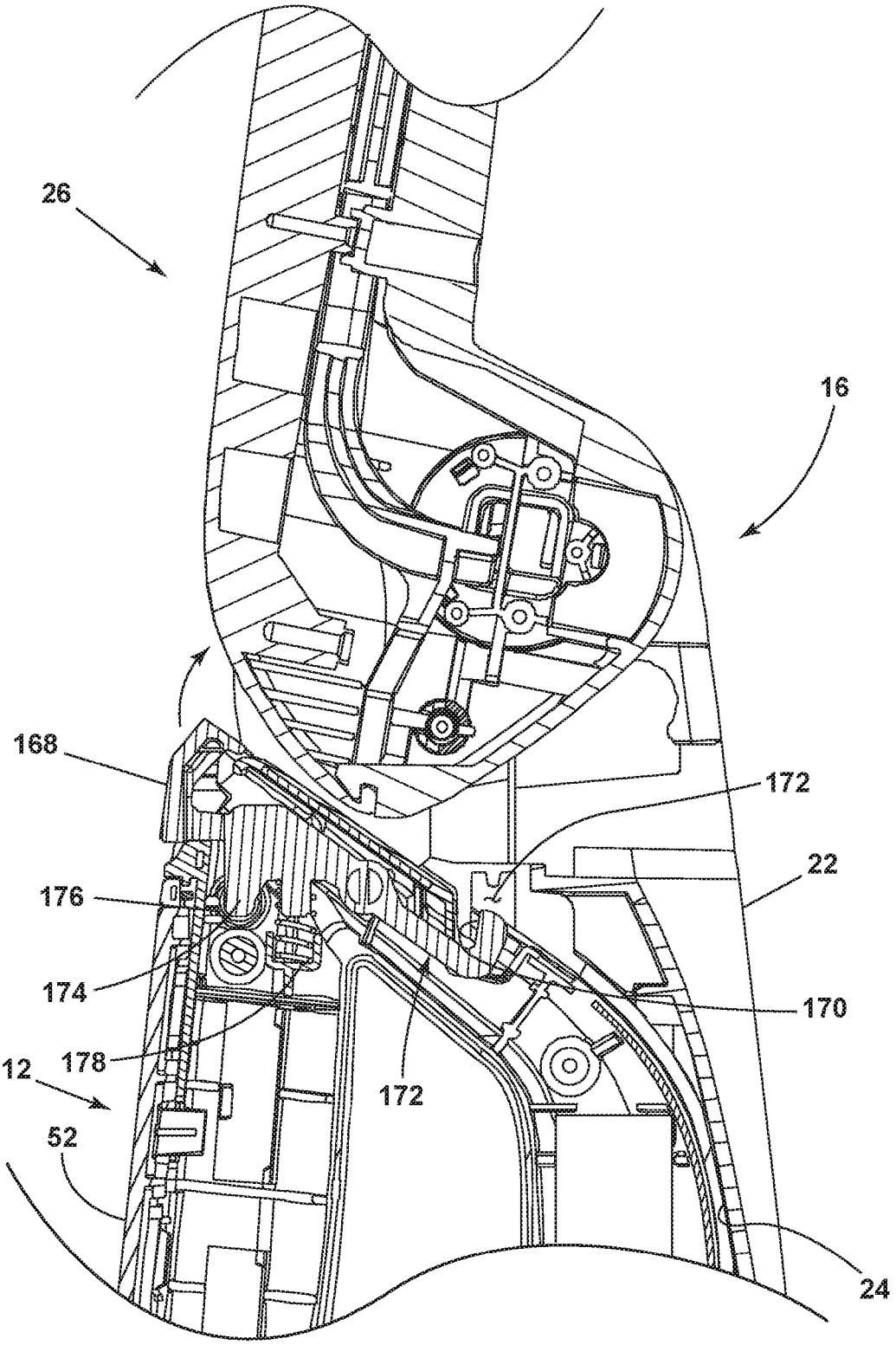
FIG. 15 is a cross-sectional view of a portion of the vacuum cleaner taken through line XV-XV of FIG. 1, showing the release latch of the hand vac engaged with upright or stick portion of the vacuum cleaner.

Referring to FIGS. 14-15, a vacuum cleaner with a detachable handheld vacuum cleaner unit (or hand vac) can be provided with a release latch that releases the handheld vacuum cleaner unit from the body of the vacuum cleaner, which may be a stick handle. In the illustrated example, the release latch is shown on the vacuum cleaner 10 with the detachable hand vac 12 and upright stick body 16, but in other examples the release latch can be used on other vacuum cleaners.

In the illustrated example, the hand vac 12 is removably mounted on the upright stick body 16 by a hand vac release latch 166. The release latch 166 includes an elongate body with a push button 168 on a one end that is accessible to a user from the exterior of the vacuum cleaner 10 when the hand vac 12 is mounted to the upright stick body 16. A hook 170 is formed at an opposite end of the release latch 166 for engaging a catch 172 on the upright stick body 16 to securely retain the hand vac 12 to the upright stick body 16 when the vacuum cleaner 10 is used in the upright mode.

The release latch 166 is mounted in the handle grip 52 of the hand vac 12, with the push button 168 on an end of the handle grip 52 and facing outwardly when the hand vac 12 is mounted to the upright stick body 16 so as to be accessible to a user.

The release latch 166 further includes pivot pins 174 protruding from a middle portion of the elongate body that is intermediate the push button 168 and hook 170. The pivot pins 174, only one of which is visible in FIGS. 14-15, are rotatably received in bearings 176 formed on the inner walls of the hand-carriable body 34 forming the handle grip 52. A spring 178 is mounted below the hook 170 and normally biases the hook 170 outwardly and upwardly about the axis defined by the pivot pins 174 to engage the catch 172 on the upright stick body 16.

In operation, to remove the hand vac 12 from the upright stick body 16, a user pushes upwardly on the push button 168, which rotates the hook 170 downwardly about the axis defined by the pivot pins 174, compressing the spring 178 and disengaging the hook 170 from the catch 172.

To the extent not already described, the different features and structures of the various examples of the disclosure, may be used in combination with each other as desired, or may be used separately. For example, the filter cleaning mechanism, filter interlock, and hand vac release latch may be found singly or in any combination thereof on a vacuum cleaner. That one vacuum cleaner is illustrated herein as having all of these features does not mean that all of these features must be used in combination, but rather done so here for brevity of description. Furthermore, while the vacuum cleaner shown herein includes a detachable hand vac such that the vacuum cleaner has an upright mode of operation and a handheld mode of operation, in some examples of the disclosure, not illustrated herein, the vacuum cleaner can be configured as a conventional upright or stick vac having only an upright mode of operation. Still further, the vacuum cleaner can additionally have fluid delivery capability, including applying liquid or steam to the surface to be cleaned, and/or fluid extraction capability. Thus, the various features of the different examples may be mixed and matched in various vacuum cleaner configurations as desired to form new examples, whether or not the new examples are expressly described.

While the invention has been specifically described in connection with certain specific examples thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the examples disclosed herein are not to be considered as limiting, unless the claims expressly state otherwise.

What is claimed is:

1. A vacuum cleaner, comprising:

a working air path comprising a dirty air inlet and a clean air outlet;

a motor/fan assembly in fluid communication with the dirty air inlet;

a motor housing for the motor/fan assembly;

a debris removal assembly including a dirt cup;

a filter assembly located within the dirt cup when the debris removal assembly is installed, wherein the dirt cup is removably coupled to the motor housing and the clean air outlet is formed in the motor housing;

a latching mechanism including a latch formed on the motor housing and a corresponding receiver on the dirt cup; and a filter interlock mechanism actuator operably coupled to the dirt cup and adapted to prevent engagement of a latching end of the latch and the corresponding receiver when the filter assembly is not installed wherein the filter interlock mechanism actuator is moveable between an interference position wherein the filter interlock mechanism actuator is adapted to prevent movement of the latching end into the corresponding receiver and a recessed position where the filter interlock mechanism actuator is free of interference with the motor housing.

2. The vacuum cleaner of claim 1 wherein the filter assembly is provided downstream of the dirty air inlet and upstream of the motor/fan assembly, with the working air path extending through the filter assembly.

3. The vacuum cleaner of claim 1 wherein the filter assembly, during installation into the dirt cup, moves the filter interlock mechanism actuator to the recessed position.

4. The vacuum cleaner of claim 3 wherein the filter assembly further includes a rib adapted to contact the filter interlock mechanism actuator during the installation of the filter assembly into the dirt cup.

5. The vacuum cleaner of claim 1, further comprising a cover plate operably coupled to the dirt cup and adapted to overlie the latch.

6. The vacuum cleaner of claim 5 wherein the cover plate further comprises a window adapted for viewing of the filter assembly through the window from an exterior of the dirt cup.

7. The vacuum cleaner of claim 1 wherein the dirt cup includes a lever selectively receivable within a portion of the motor housing.

8. The vacuum cleaner of claim 1 wherein the vacuum cleaner is an upright vacuum cleaner comprising a detachable handheld cleaning unit.

9. The vacuum cleaner of claim 8, further comprising an upright stick body that is pivotally connected to a floor cleaning head having a suction nozzle defining the dirty air inlet, wherein the detachable handheld cleaning unit is detachable from the upright stick body.

10. The vacuum cleaner of claim 8, further comprising an upright stick body that is pivotally connected to a floor cleaning head having a suction nozzle defining the dirty air inlet, wherein the detachable handheld cleaning unit is detachable from the upright stick body.

11. The vacuum cleaner of claim 1 wherein the vacuum cleaner is a handheld cleaning unit and comprises a hand-carriable unit with a handle grip, wherein the dirty air inlet and clean air outlet are provided on the hand-carriable unit.

12. A vacuum cleaner, comprising:

a working air path comprising a dirty air inlet and a clean air outlet;

a motor/fan assembly in fluid communication with the dirty air inlet;

a motor housing for the motor/fan assembly;

a debris removal assembly including a dirt cup;

a filter assembly located within the dirt cup when the debris removal assembly is installed, wherein the dirt cup is removably coupled to the motor housing and the clean air outlet is formed in the motor housing;

a latching mechanism including a latch formed on the motor housing and a corresponding receiver on the dirt cup; and a filter interlock mechanism actuator adapted to prevent engagement of a latching end of the latch and the corresponding receiver when the filter assembly is not installed the filter interlock mechanism actuator comprising a member pivotally mounted to the dirt cup about a pivot axis via a hinge, the member pivotable between a first position where the member is adapted to prevent installation of the dirt cup to a housing if the filter assembly is not installed therein and a second position free of interference where the filter assembly contacts the dirt cup when assembled, wherein the member is biased outwardly from the dirt cup by a spring.

13. The vacuum cleaner of claim 12 wherein the filter assembly further includes a rib adapted to contact the member during installation of the filter assembly into the dirt cup and adapted to pivot the member from the first position to the second position.

14. The vacuum cleaner of claim 12 wherein the filter assembly is provided downstream of the dirty air inlet and upstream of the motor/fan assembly, with the working air path extending through the filter assembly.

15. A vacuum cleaner, comprising:

a working air path comprising a dirty air inlet and a clean air outlet;

a motor/fan assembly in fluid communication with the dirty air inlet;

a motor housing for the motor/fan assembly;

a debris removal assembly including a dirt cup;

a filter assembly located within the dirt cup when the debris removal assembly is installed, wherein the dirt cup is removably coupled to the motor housing and the clean air outlet is formed in the motor housing;

a latching mechanism including a latch formed on the motor housing and a corresponding receiver on the dirt cup; and a filter interlock mechanism actuator adapted to prevent engagement of a latching end of the latch and the corresponding receiver when the filter assembly is not installed the filter interlock mechanism actuator comprising a member pivotally mounted to a portion of the dirt cup via a hinge coupling, where the filter assembly contacts the dirt cup when assembled and wherein the member is biased outwardly from the dirt cup by a spring.

16. The vacuum cleaner of claim 15 wherein the member is pivotable between a first position where the member is adapted to prevent installation of the dirt cup to a housing if the filter assembly is not installed therein and a second position free of interference.

17. The vacuum cleaner of claim 16 wherein the filter assembly further includes a rib adapted to contact the member during installation of the filter assembly into the dirt cup and adapted to pivot the member from the first position to the second position.

18. The vacuum cleaner of claim 15 wherein the filter assembly is provided downstream of the dirty air inlet and upstream of the motor/fan assembly, with the working air path extending through the filter assembly.

19. The vacuum cleaner of claim 15 wherein the vacuum cleaner is an upright vacuum cleaner comprising a detachable handheld cleaning unit.

20. The vacuum cleaner of claim 15 wherein the vacuum cleaner is a handheld cleaning unit and comprises a hand-carriable unit with a handle grip, wherein the dirty air inlet and clean air outlet are provided on the hand-carriable unit.

* * * * *